US010641096B2

(12) United States Patent
Kampka et al.

(10) Patent No.: US 10,641,096 B2
(45) Date of Patent: May 5, 2020

(54) ROTOR WITH A LOCKING PLATE FOR SECURING AN ANTIROTATION LOCK AGAINST UNSCREWING

(71) Applicant: Siemens Aktiengesellschaft, Munich (DE)

(72) Inventors: Kevin Kampka, Mülheim a.d. Ruhr (DE); Karsten Kolk, Mülheim a.d. Ruhr (DE); Peter Schröder, Essen (DE); Vyacheslav Veitsman, Gelsenkirchen (DE)

(73) Assignee: Siemens Aktiengesellschaft, Munich (DE)

( * ) Notice: Subject to any disclaimer, the term of this patent is extended or adjusted under 35 U.S.C. 154(b) by 67 days.

(21) Appl. No.: 15/550,198

(22) PCT Filed: Jan. 7, 2016

(86) PCT No.: PCT/EP2016/050193
§ 371 (c)(1),
(2) Date: Aug. 10, 2017

(87) PCT Pub. No.: WO2016/139002
PCT Pub. Date: Sep. 9, 2016

(65) Prior Publication Data

US 2018/0023394 A1 Jan. 25, 2018

(30) Foreign Application Priority Data

Mar. 4, 2015 (EP) ..... 15157557

(51) Int. Cl.
*F01D 5/06* (2006.01)
*F01D 5/08* (2006.01)
(Continued)

(52) U.S. Cl.
CPC ..... *F01D 5/066* (2013.01); *F01D 5/082* (2013.01); *F01D 5/087* (2013.01); *F01D 5/3015* (2013.01);
(Continued)

(58) Field of Classification Search
CPC ..... F01D 5/30; F01D 5/3007; F01D 5/3015; F01D 5/3023; F01D 5/303; F01D 5/3038;
(Continued)

(56) References Cited

U.S. PATENT DOCUMENTS 2,861,823 A 11/1958 Perry
4,247,256 A 1/1981 Maghon
(Continued)

FOREIGN PATENT DOCUMENTS

DE 2643886 B1 6/1977
EP 1277917 A1 1/2003
RU 2230195 C2 6/2004

OTHER PUBLICATIONS

International Search Report dated May 3, 2016, for PCT/EP2016/050193.
(Continued)

*Primary Examiner* — Jacob M Amick
*Assistant Examiner* — Rubin Picon-Feliciano
(74) *Attorney, Agent, or Firm* — Beusser Wolter Sanks & Maire

(57) ABSTRACT

A rotor, in particular a gas turbine rotor, having multiple rotor discs, each of which has an axial through-opening, and the rotor discs are axially clamped by at least one tie rod extending through the through-openings and are combined so as to form at least one rotor disc unit. At least one support ring which surrounds the tie rod and is in engagement with a paired rotor disc rests against the outer diameter of the tie rod, and the tie rod is supported against the rotor disc by the
(Continued)

support ring. In order to axially secure the at least one support ring, at least one securing ring is provided which is secured to the paired rotor disc by a rotational lock and which holds the support ring against the rotor disc. The securing ring is prevented from unscrewing by a securing plate.

13 Claims, 5 Drawing Sheets

(51) Int. Cl.
*F01D 5/30* (2006.01)
*F04D 29/26* (2006.01)

(52) U.S. Cl.
CPC ..... *F01D 5/3069* (2013.01); *F04D 29/266* (2013.01); *F05D 2260/30* (2013.01); *F05D 2260/33* (2013.01); *F05D 2260/96* (2013.01)

(58) Field of Classification Search
CPC ..... F01D 5/3069; F01D 5/32; F01D 5/323; F01D 5/326; F01D 11/008; F01D 5/066; F01D 5/10; F05D 2260/33; F05D 2260/36; F05D 2260/37; F05D 2260/30
See application file for complete search history.

(56) References Cited

U.S. PATENT DOCUMENTS 4,558,988 A * 12/1985 Kisling ..... F01D 5/3015 416/220 R
2013/0156589 A1* 6/2013 Paquet ..... F01D 5/3015 416/220 R

OTHER PUBLICATIONS

EP Search Report dated Sep. 22, 2015, for EP patent application No. 15157557.8.

* cited by examiner

ROTOR WITH A LOCKING PLATE FOR SECURING AN ANTIROTATION LOCK AGAINST UNSCREWING

CROSS REFERENCE TO RELATED APPLICATIONS

This application is the US National Stage of International Application No. PCT/EP2016/050193 filed Jan. 7, 2016, and claims the benefit thereof. The International Application claims the benefit of European Application No. EP15157557 filed Mar. 4, 2015. All of the applications are incorporated by reference herein in their entirety.

FIELD OF INVENTION

The present invention relates to a rotor, especially to a gas turbine rotor, with a plurality of rotor disks having in each case an axial through-hole, which rotor disks, via at least one tie rod extending through the through-holes, are axially clamped and assembled to form at least one rotor disk unit, wherein at least one support ring, encompassing the tie rod, butts against the outside diameter of the tie rod, which support ring engages with an associated rotor disk and is supported on the rotor disk via the tie rod, and wherein for axially securing the at least one support ring provision is made for at least one locking ring.

BACKGROUND OF INVENTION

Such rotors, which are assembled from a multiplicity of individual rotor disks, forming one or more rotor-disk groups, are known in the prior art in a wide variety of embodiments. The rotor disks of each rotor disk unit are pressed flat against each other via the tie rod, wherein the pressure force is normally created by screw-nuts which are screwed onto the tie rod at the end. In most cases, directly adjacently arranged rotor disks are additionally interconnected and centered via a form fit. Such a form fit can for example be formed via a so-called Hirth toothing.

During operation, the rotor is exposed to mechanical vibrations, the frequency of which is dependent inter alia on the freely vibrating length of the tie rod. With increasing overall length of a rotor, the freely vibrating length of the tie rod also increases, which leads to its natural frequency shifting to a lower level close to the rotational frequency of the rotor. Such a frequency shift can involve unacceptably high vibration amplitudes which can impair the function of the rotor and lead to damage.

For reducing the freely vibrating length of the tie rod, it is already known to attach at least one support ring on the outside diameter of the tie rod and to connect it to one of the rotor disks. Via such a support ring, the tie rod can be supported on the corresponding rotor disk. Therefore, for example DE 2 643 886 proposes a support ring in the form of a push-on ring with a widening inside diameter, wherein the push-on ring by its free end of larger inside diameter engages in an annular slot which is provided on the associated rotor disk and by the smallest inside diameter is supported on the tie rod. During operation, the end of the push-on ring which is connected to the rotor disk is widened on account of a centrifugal force stretching of the rotor disk in such a way that the inside diameter of the push-on ring which butts against the outer circumference of the tie rod presses against the tie rod at the end, as a result of which a fixed clamping between the rotor disk and the tie rod is achieved, and therefore the desired support effect.

In order to prevent the effect of a support ring being able to be displaced axially along the outer circumference of the tie rod, it is also known to axially secure the support ring by means of an additional locking ring. Therefore, DE 2 643 886 proposes for example the use of a sleeve-like locking ring which is inserted between the support ring and a further rotor disk and together with the rotor disks is clamped via the tie rod. If a further rotor disk is not available, then a dummy rotor disk has to be used in order to be able to press the locking sleeve axially next to the support ring. The use of such a dummy rotor disk, however, is accompanied by high costs, which is not desirable.

SUMMARY OF INVENTION

Starting from this prior art, it is an object of the present invention to create an inexpensive rotor of the type referred to in the introduction with an alternative construction.

For achieving this object, the present invention creates a rotor of the type referred to in the introduction which is characterized in that the locking ring is fastened on the associated rotor disk by means of an antirotation lock and retains the support ring on this, wherein the locking ring is secured against unscrewing by the use of a locking plate. According to the invention, the support ring is therefore enclosed in the axial direction on one side by the rotor disk to which it is connected, and on the other side by the locking ring which is fastened on the same rotor disk. Clamping of the locking ring against the support ring via the tie rod is therefore unnecessary. The use of a dummy rotor disk can be dispensed with accordingly. The fastening of the locking ring on the rotor disk is carried out by means of an antirotation lock which by means of a locking plate is secured against unscrewing, which leads to a simple and inexpensive construction of the rotor.

According to an embodiment of the present invention, the locking plate engages with the locking ring and with the associated rotor disk. In this way, a simple construction is achieved.

In the case of a rotor according to the invention, the locking ring advantageously has a recess for receiving the locking plate, which recess extends in an L-shaped manner over an outer circumferential surface of the locking ring and over an end face of the locking ring which faces the associated rotor disk. Such an L-shaped recess can be formed on a locking ring with low cost—even retrospectively—by means of milling, for example, and enables fixing of the locking plate on the locking ring.

The rotor disk which is associated with the locking ring advantageously has a radially extending cutout on an outer end face for receiving the locking plate, which cutout is positioned in such a way that it aligns with the recess of the locking ring when this is located in a locking position. This cutout on the associated rotor disk can also be formed in the rotor disk—even retrospectively—with low cost by means of milling, for example. Its position at the same time defines a measure of how far the locking ring has to be rotated in relation to the associated rotor disk in order to ensure the fastening of the locking ring on the rotor disk.

According to a further embodiment of the rotor according to the invention, the locking plate has a Z-shaped design and is accommodated in the recess of the locking ring and in the cutout of the rotor disk. For achieving the Z-shaped design, an L-shaped locking plate is advantageously first of all inserted into an L-shaped recess of the locking ring, the locking ring is then brought into engagement with the associated rotor disk and fastened on this by means of the antirotation lock, after which the free leg of the locking plate, which is accessible from the outside, is bent into a cutout of the rotor disk, as a result of which the Z-shaped design ensues.

The antirotation lock is advantageously designed as a bayonet connection. Alternatively, a screwed connection, for example, can also serve as the antirotation lock.

In the case of a bayonet connection, the locking ring has radially projecting bayonet lugs distributed along its circumference which engage in an annular bayonet slot provided on the associated rotor disk, which bayonet slot is provided with bayonet-lug receiving openings which are formed to correspond to the bayonet lugs and enable an axial insertion of the bayonet lugs into the bayonet slot.

According to one embodiment of the rotor according to the invention, the recess of the locking ring splits one of the bayonet lugs. This design of the recess of the locking ring ensures that the locking plate cannot make its way out of the recess during a rotation of the locking ring during installation. The recess can especially split one of the bayonet lugs in the middle.

According to a further embodiment according to the invention, the support ring has a widening inside diameter and by its free end of larger inside diameter engages in an annular slot which is provided on the associated rotor disk. Therefore, the support ring can be designed for example in a similar way to the push-on ring which is disclosed in DE 26 43 886.

The present invention also relates to the use of a locking plate for securing a locking ring, which keeps a support ring in engagement with a rotor disk, against unscrewing.

BRIEF DESCRIPTION OF THE DRAWINGS

Further features and advantages of the present invention become clear based on the following description of a rotor according to an embodiment of the present invention with reference to the accompanying drawing. In the drawing

DETAILED DESCRIPTION OF INVENTION

Figure 1:
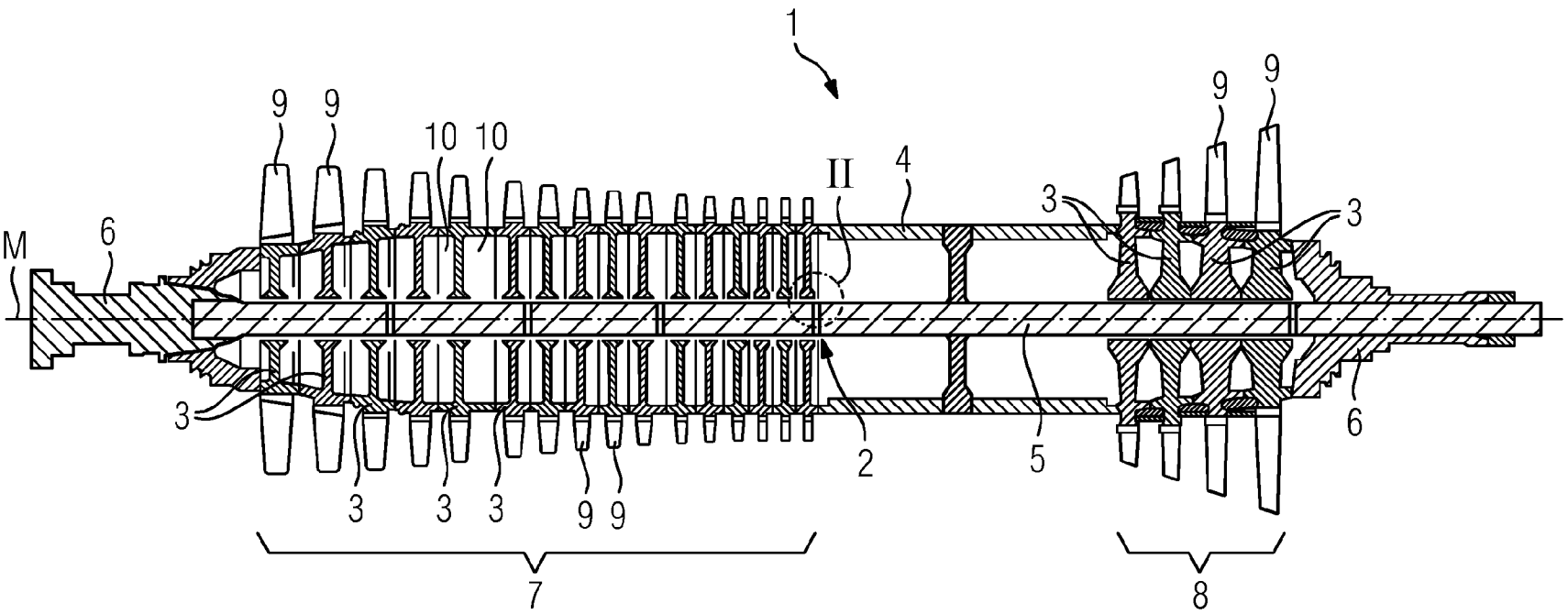
FIG. 1 shows a schematic cross-sectional view of a rotor according to the present invention.

FIGS. 1 to 7 show a rotor according to an embodiment of the present invention. The rotor 1, which in the present case forms a gas turbine rotor, comprises a multiplicity of rotor disks 3 having in each case an axial through-hole 2, a hollow shaft 4 and a tie rod 5 which extends through the through-hole 2 and through the hollow shaft 4 and via which the rotor disks 3 and the hollow shaft 4 are axially clamped in a known manner using clamping parts 6 which are screwed onto the tie rod 5 at the end. In this case, the rotor disks 3 are assembled to form a compressor-side rotor disk unit 7 and a turbine-side rotor disk unit 8, wherein the hollow shaft 4 is arranged between the two rotor disk units 7 and 8. The end faces, which face each other, of directly adjacently arranged rotor disks 3 are provided in each case with a Hirth toothing, not shown in more detail, as a result of which, as a consequence of the clamping by means of the tie rod, a form-fitting connection between the adjacent rotor disks 3 and a centering with regard to the center axis M of the rotor 1 is also achieved. Rotor blades 9 are arranged on the outer circumference of the respective rotor disks 3. Interspaces 10, which are provided between the rotor disks 3, serve for the conducting of a cooling fluid for cooling the rotor disks 3 which is fed via a cooling passage which is formed between the tie rod 5 and the rotor disks 3 or the hollow shaft 4.

Figure 2:
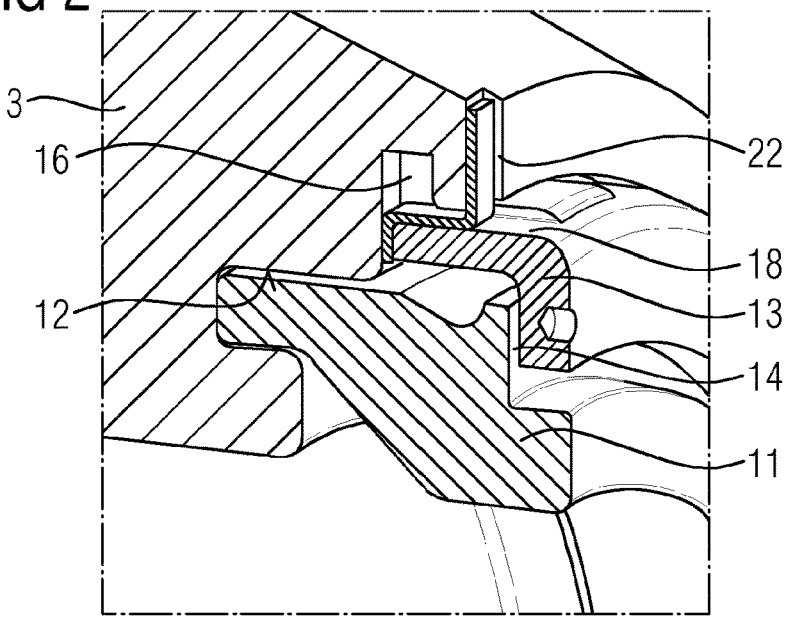
FIG. 2 shows an enlarged perspective sectional view of the detail identified by the designation II in FIG. 1, which shows an arrangement according to an embodiment of the present invention.
Figure 3:
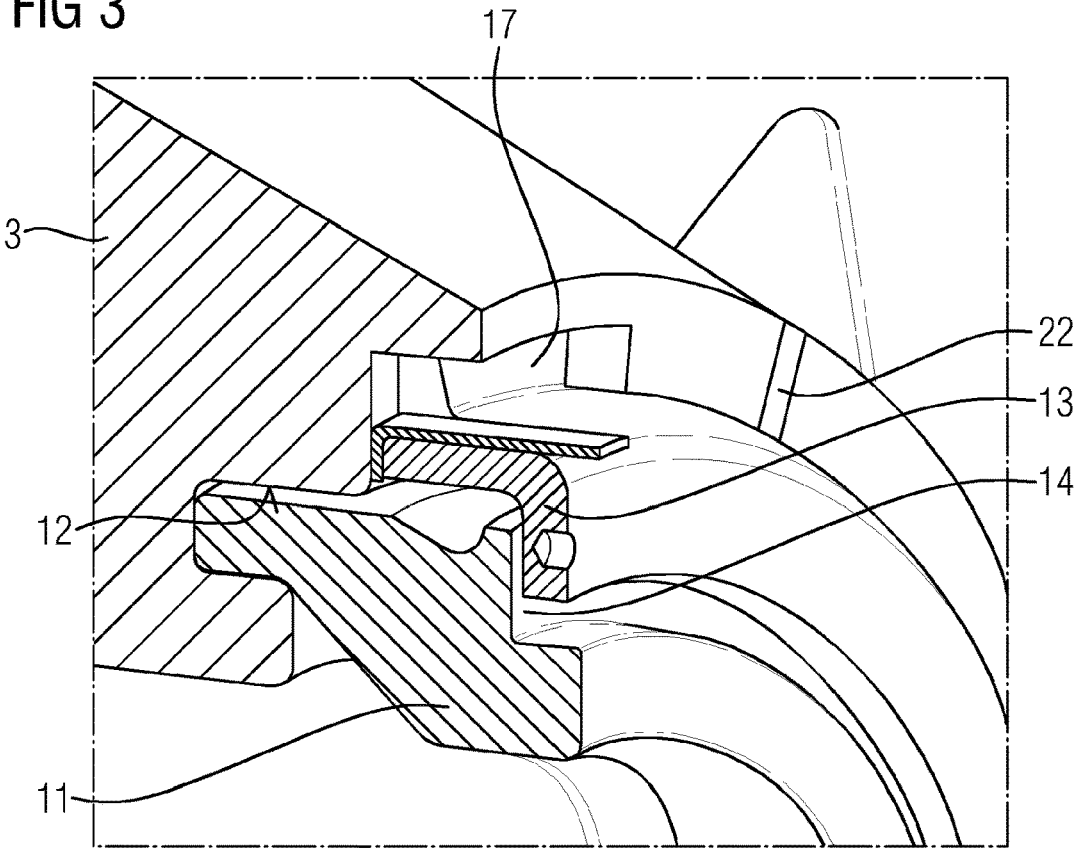
FIG. 3 shows a perspective sectional view of the embodiment of the present invention shown in FIG. 2 in the unlocked and unsecured state.
Figure 4:
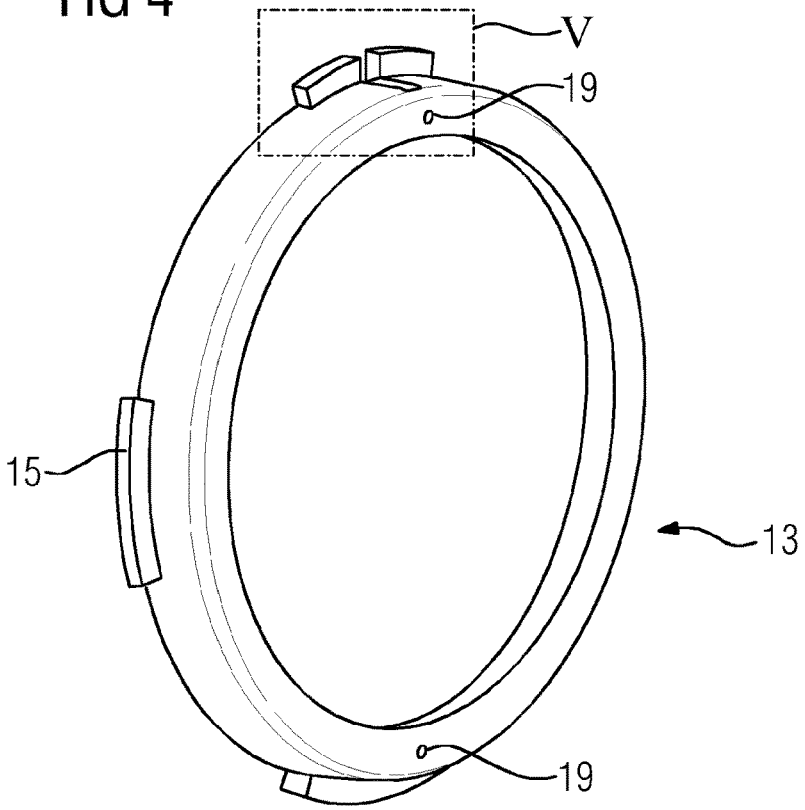
FIG. 4 shows a perspective view of a locking ring of the embodiment of the present invention shown in FIGS. 2 and 3.
Figure 5:
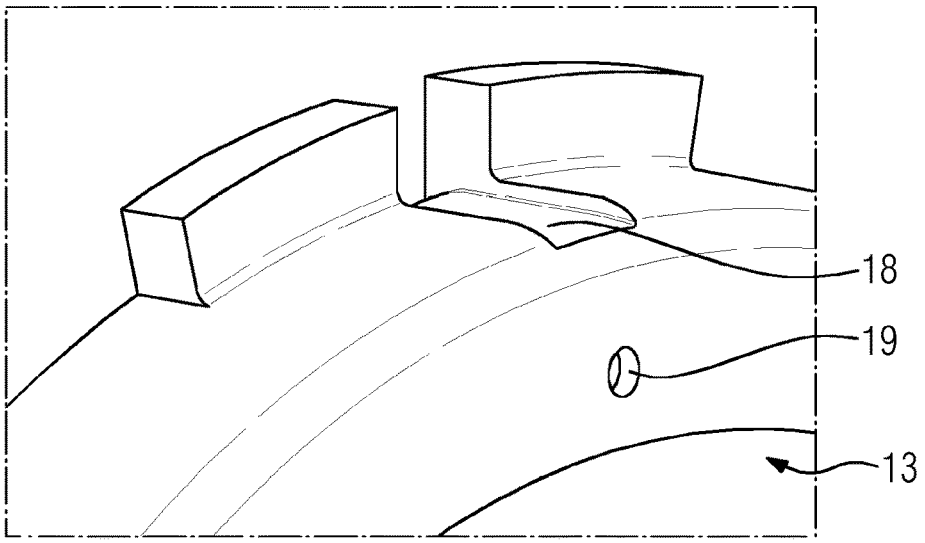
FIG. 5 shows an enlarged perspective view of the detail identified by the designation V in FIG. 4.
Figure 6:
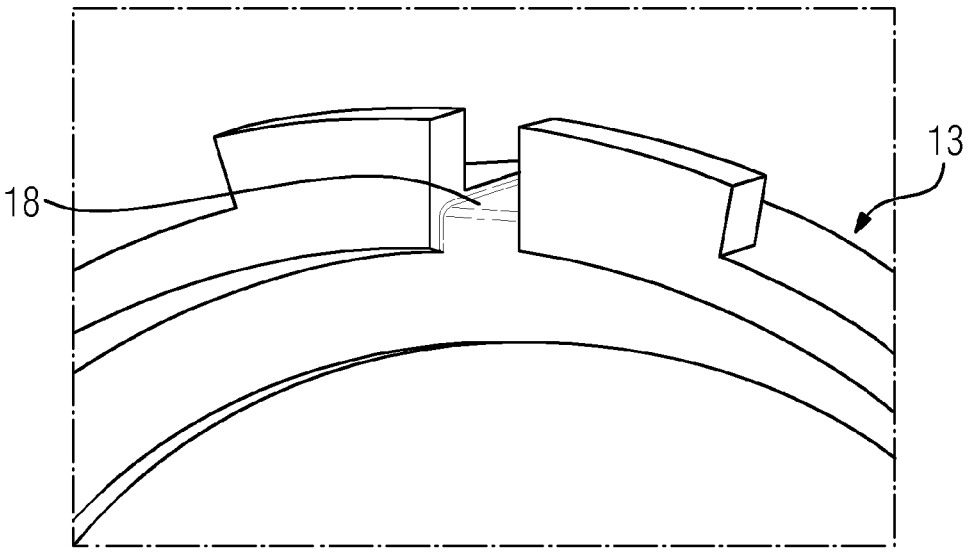
FIG. 6 shows a perspective rear view of the detail shown in FIG. 5.
Figure 7:
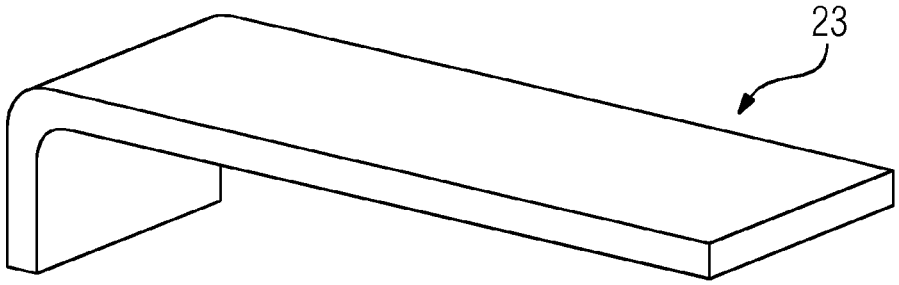
FIG. 7 shows a perspective view of a locking plate for an arrangement according to an embodiment of the present invention.
Figure 8:
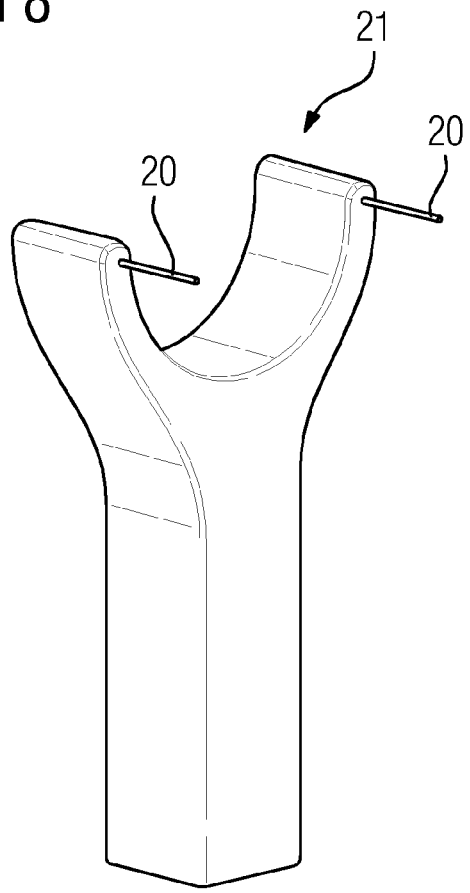
FIG. 8 shows a perspective view of a locking tool for the locking ring shown in FIG. 4.

On account of the long length of the tie rod 5, a plurality of support rings 11 butt against its outside diameter, which, as is shown in FIGS. 2 and 3, engage with one of the rotor disks 3 in each case. Each support ring 11 has a widening inside diameter, wherein the free end with the larger inside diameter engages in each case in an annular slot 12 which is provided on the adjacently disposed rotor disk 3. For axially securing the support ring 11, provision is made for a locking ring 13 which is fastened in each case on that rotor disk 3 by means of an antirotation lock in which also engages the associated support ring 11. The locking ring 13 is designed in such a way that it encompasses an end face 14 of the associated support ring 11 which points away from the associated rotor disk 3. Each locking ring 13 is produced in one piece from metal.

The antirotation lock between the locking ring 13 and the rotor disk 3 is designed as a bayonet connection. For realizing the bayonet connection, the locking ring 13 has radially projecting bayonet lugs 15 which are distributed along its circumference and engage in an annular bayonet slot 16 which is provided on the associated rotor disk 3 and is provided with bayonet-lug receiving openings 17 which are designed to correspond to the bayonet lugs 15 and enable an axial insertion of the bayonet lugs 15 into the bayonet slot 16. Correspondingly, the locking ring 13 can be pushed axially over the support ring 11, wherein the bayonet lugs 15 are inserted into the associated bayonet-lug receiving openings 17, after which the bayonet lugs 15 are axially fixed in the course of a rotational movement of the locking ring 13 in the bayonet slot 16.

The locking ring 13 has an L-shaped recess 18 which extends over an outer circumferential surface of the locking ring 13 and over an end face of the locking ring 13 facing the associated rotor disk 3 and splits a bayonet lug 15 in the middle. On the end face of the locking ring 13 facing away from the rotor disk 3 provision is made for two radially oppositely disposed receiving openings 19 which can receive corresponding protrusions 20 of a locking tool 21.

Formed in an outer end face of the rotor disk 3 is a radially extending cutout 22, the width of which corresponds in the main to the width of the recess 18 which is provided on the locking ring 13. The cutout 22 is positioned on the end face of the rotor disk 3 in such a way that it aligns with the recess 18 of the locking ring 13 when this is located in a locking position.

As security against unscrewing, provision is made for a locking plate 23 which in the designated installed state prevents unscrewing of the locking ring 13 from the locking position. The locking plate 23 has a Z-shaped design and is accommodated in the recess 18 of the locking ring 13 and in the cutout 22 of the rotor disk 3. To this end, the width of the locking plate 23 corresponds in the main to the widths of the recess 18 and of the cutout 22.

For installing the locking ring 13, the locking ring 13 is first of all slipped over the tie rod 5 so that it encompasses the support ring 11. Then, the initially L-shaped locking plate 23 in the preassembled state is inserted into the L-shaped recess 18 of the locking ring 13. The locking ring 13 which is provided with the locking plate 23 is then axially inserted into the bayonet slot 16 of the rotor disk 3, wherein the bayonet lugs 15 are inserted into the corresponding bayonet-lug receiving openings 17. Using the locking tool 21, the protrusions 20 of which are inserted into the receiving openings 19 provided on the locking ring 13, the locking ring 13 is now rotated in the bayonet slot until the recess 18 of the locking ring 13 aligns with the cutout 22 of the rotor disk 3. Now, the support ring 11 is axially retained between the rotor disk 3 and the locking ring 13 and correspondingly secured. The projecting free end of the locking plate 23 is finally bent into the cutout 22 of the rotor disk 3.

An essential advantage of the locking ring 13 according to the invention exists in the fact that this is not clamped against the associated support ring 11 via the tie rod 5, which is why support rings 11 can be installed in a simple and inexpensive manner regardless of their position. Retrofitting is also possible without great cost. On account of its simple construction, the locking ring 13, moreover, can be produced cost-effectively. The use of a locking plate 23 for securing the locking ring 13 against unscrewing furthermore offers the advantage that during installation forces are exerted neither on the rotor disk 3 nor on the locking ring 13, as a result of which undesirable deformations and/or crack formations are avoided. Also, the arrangement can be disassembled without any problem, which is advantageous during maintenance operations or repair operations. Furthermore, the recesses 18 or cutouts 22 which are required can also be introduced retrospectively in locking rings 13 and rotor disks 3 in a simple manner so that existing unscrewing locking devices can be replaced by an unscrewing lock according to the invention.

Although the invention has been fully illustrated and described in detail by means of the preferred exemplary embodiment, the invention is not limited by the disclosed examples and other variations can be derived therefrom by the person skilled in the art without departing from the extent of protection of the invention.

The invention claimed is:

1. A rotor, comprising:

a plurality of rotor disks comprising in each case an axial through-hole, which rotor disks are axially clamped via at least one tie rod extending through the axial through-holes and are assembled to form at least one rotor disk unit, at least one support ring, which encompasses the at least one tie rod, that butts against an outside diameter of the at least one tie rod, which engages directly with an associated rotor disk of the plurality of rotor disks and via the at least one support ring the at least one tie rod is supported on the associated rotor disk, at least one locking ring that abuts the at least one support ring, that is axially interlocked directly with the associated rotor disk via a connection, and that captures the at least one support ring between the at least one locking ring and the associated rotor disk, wherein engaging the connection requires rotation of the at least one locking ring relative to the associated rotor disk, and a locking plate configured to prevent the rotation of the at least one locking ring once the connection is engaged, wherein the at least one locking ring comprises a recess which accommodates the locking plate and extends in an L-shaped manner over an outer circumferential surface of the at least one locking ring and over an end face of the at least one locking ring which faces the associated rotor disk.

2. The rotor as claimed in claim 1, wherein the locking plate engages with the at least one locking ring and with the associated rotor disk.

3. The rotor as claimed in claim 1, wherein the associated rotor disk comprises a radially extending cutout on an outer end face for receiving the locking plate and the radially extending cutout is positioned in such a way that the radially extending cutout aligns with the recess of the at least one locking ring when the at least one locking ring is in a locking position.

4. The rotor as claimed in claim 1, wherein the locking plate comprises a Z-shaped design and is accommodated in the recess of the at least one locking ring and in a cutout of the associated rotor disk.

5. The rotor as claimed in claim 1, wherein the connection comprises a bayonet connection.

6. The rotor as claimed in claim 5, wherein the at least one locking ring comprises radially projecting bayonet lugs distributed along its circumference which engage in an annular bayonet slot provided on the associated rotor disk, which bayonet slot comprises bayonet-lug receiving openings which are designed to correspond to the bayonet lugs and enable an axial insertion of the bayonet lugs into the bayonet slot prior to the rotation of the at least one locking ring to engage the connection.

7. The rotor as claimed in claim 5, wherein the recess of the locking ring splits one of the bayonet lugs.

8. The rotor as claimed in claim 7, wherein the recess of the locking ring splits one of the bayonet lugs in the middle.

9. The rotor as claimed in claim 1, wherein the at least one support ring comprises a widening inside diameter, and wherein the at least one support ring engages by its free end of larger inside diameter in an annular slot which is provided on the associated rotor disk.

10. The rotor as claimed in claim 1, wherein the rotor comprises a gas turbine rotor.

11. A method for securing at least one locking ring for a rotor comprising a plurality of rotor disks comprising in each case an axial through-hole, which rotor disks are axially clamped via at least one tie rod extending through the axial through-holes and are assembled to form at least one rotor disk unit, wherein at least one support ring, which encompasses the tie rod, butts against an outside diameter of the at least one tie rod, which support ring engages directly with an associated rotor disk of the plurality of rotor disks and via the at least one support ring the at least one tie rod is supported on the associated rotor disk, the method comprising:

axially securing the at least one support ring with the at least one locking ring, wherein the at least one locking ring abuts the support ring, is axially interlocked directly with the associated rotor disk by a connection, and captures the at least one the support ring between the at least one locking ring and the associated rotor disk, wherein engaging the connection requires rotation of the at least one locking ring relative to the associated rotor disk; and keeping the at least one support ring in engagement with the associated rotor disk by using a locking plate configured to prevent the rotation of the at least one locking ring once the connection is engaged, wherein the at least one locking ring comprises a recess which accommodates the locking plate and extends in an L-shaped manner over an outer circumferential surface of the at least one locking ring and over an end face of the at least one locking ring which faces the associated rotor disk.

12. A rotor, comprising:

a tie rod;

a plurality of rotor disks clamped together by the tie rod that extends therethrough;

a support ring that: surrounds and abuts the tie rod; that that directly engages with an associated rotor disk of the plurality of rotor disks; and through which the associated rotor disk supports the tie rod;

a locking ring that abuts the support ring, that is axially interlocked directly with the associated rotor disk via a connection, and that captures the support ring between the locking ring and the associated rotor disk, wherein engaging the connection requires rotation of the locking ring relative to the associated rotor disk; and a locking plate configured to engage a cutout in the associated rotor disk and to engage a recess in the locking ring, thereby preventing circumferential movement of the locking ring relative to the associated rotor disk and thereby maintain the connection, wherein the recess extends in an L-shaped manner over an outer circumferential surface of the locking ring and over an end face of the locking ring which faces the associated rotor disk.

13. The rotor of claim 12, wherein the locking ring comprises a radial projection comprising the recess;

wherein the associated rotor disk comprises a slot;

wherein the locking ring engages the associated rotor disk by moving the radial projection axially into the slot and then moving the radial projection circumferentially within the slot until the recess aligns with the cutout; and wherein a free end of the locking plate is bent into the cutout to form a Z-shaped locking plate that circumferentially interlocks the locking ring to the associated rotor disk.

* * * * *